United States Patent [19]

Rusinek, Jr. et al.

[11] 4,131,106

[45] Dec. 26, 1978

[54] ENERGY SAVING FIREPLACE

[76] Inventors: Stanley Rusinek, Jr.; George Spector, both c/o George Spector, 3615 Woolworth Bldg., 233 Broadway, New York, N.Y. 10007

[21] Appl. No.: 728,467

[22] Filed: Sep. 30, 1976

[51] Int. Cl.[2] ..... F24B 7/00

[52] U.S. Cl. ..... 126/121; 126/164

[58] Field of Search ..... 126/121, 164, 165; 237/51

[56] References Cited

U.S. PATENT DOCUMENTS

| | | | |
|---|---|---|---|
| 2,828,078 | 3/1958 | Snodgrass | 126/121 |
| 3,901,212 | 8/1975 | Stites | 126/165 |
| 3,930,490 | 1/1976 | Lassey et al. | 126/121 |
| 3,955,553 | 5/1976 | Soeffer | 126/121 |

*Primary Examiner*—Ronald C. Capossela

[57] ABSTRACT

A superheater for a fireplace in order to obtain a greater amount of the heat from a fire and move the heat into the room; the device consisting of a cradle upon a middle of which logs can be placed for burning, the cradle consisting of a series of pipes through which air is forced so to become heated before blown into the room, the air intake side of the pipes being connected to a manifold into which a duct leads from the outside of the house so that fresh air, laden with oxygen, enters the room hot and maintains more oxygen for the fire so to burn more intensely.

2 Claims, 4 Drawing Figures

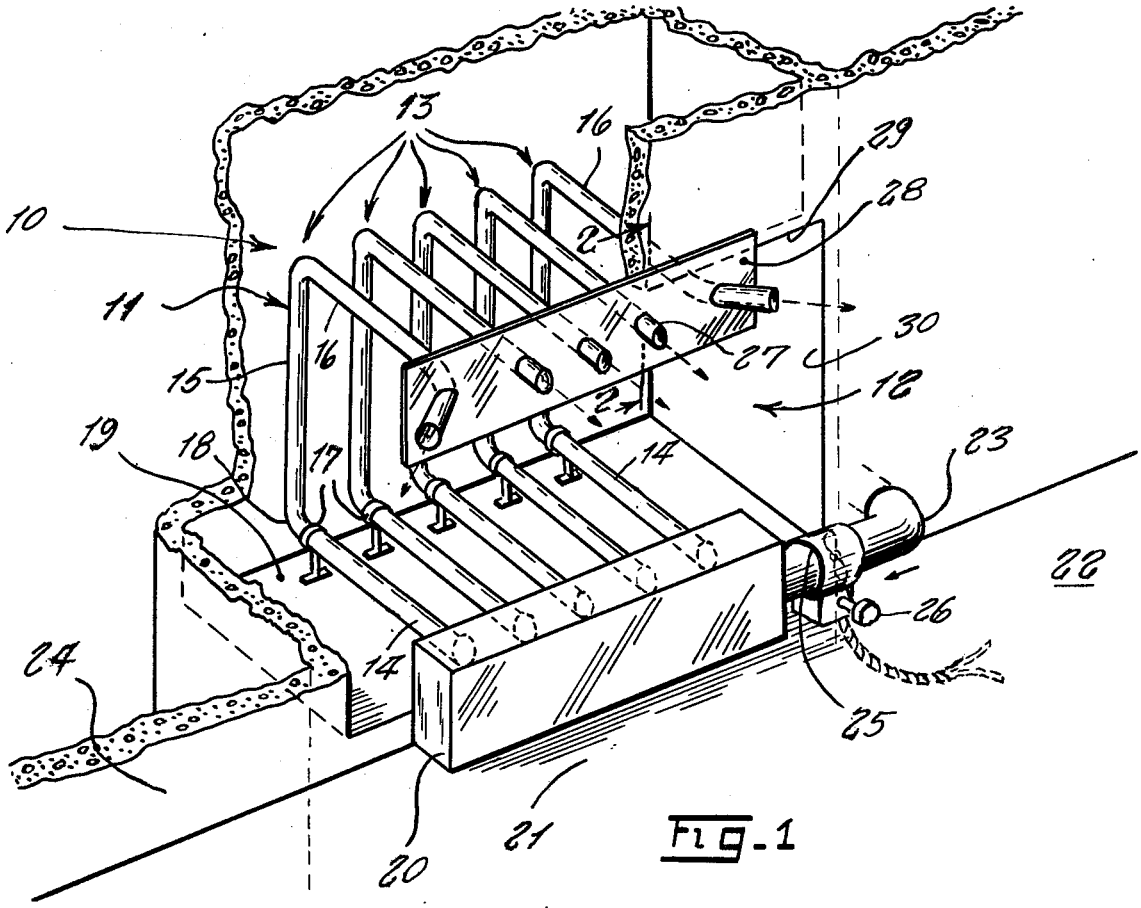
Fig. 1
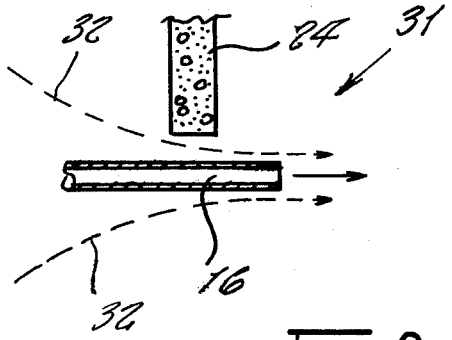
Fig. 3
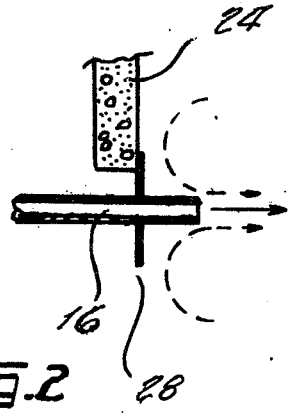
Fig. 2
Fig. 4
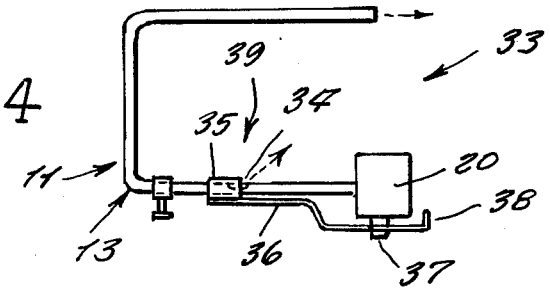

ENERGY SAVING FIREPLACE

This invention relates generally to superheaters for fireplaces.

A principal object of the present invention is to provide a heat exchanger for installation in a fireplace so to absorb heat from a fire and transmit the heat directly into the interior of a room, so that a greater amount of the heat that is generated by a fire is utilized instead of being allowed to go up a chimney and wasted.

Another object is to provide an energy saving fireplace heater which additionally brings heated air into the room which is laden with oxygen, so to be beneficial to persons in the room and which feeds the fire so to burn more intensely.

Another object is to provide an energy saving fireplace heater which obtains up to 50 percent more heat in a room from a same fire that is not thus equipped.

Other objects are to provide an ENERGY SAVING FIREPLACE HEATER which is simple in design, inexpensive to manufacture, rugged in construction, easy to use and efficient in operation.

These and other objects will be readily evident upon a study of the following specification and accompanying drawing wherein:

FIG. 1 is a perspective view of the present invention shown installed within a fireplace.

FIG. 2 is a cross sectional view taken on line 2–2 of FIG. 1.

FIG. 3 is a cross sectional view showing a modified design of the structure of FIG. 2, for producing a modified result in heat effectiveness within a room.

FIG. 4 is a side view of a modified design of the invention in which additional control means are provided for the heater to blast oxygen laden air directly under a fire so to make it burn more intensely.

Refering now to the drawing in greater detail, and more particularly to FIGS. 1 and 2 at the present time, the reference number 10 represents an energy saving fireplace heater according to the present invention wherein there is a cradle 11 for being installed within a fireplace 12, and upon which logs may be placed for being burned.

The cradle consists of a series of generally C-shaped, metal pipes 13 which are placed in spaced apart relation alongside each other, so that together they form a grill-like enclosure from which smoke, and flames can pass outwardly up, heat outwardly in all directions, and ashes drop downardly. Each pipe includes a horizontal lower leg 14, a vertical rear leg 15 and horizontal upper leg 16. A leg 17 is secured to a rear portion of leg 14 near a bend 18, so to support the rear of the pipe in an elevated position above the fireplace floor 19.

A forward end of each leg 17 is connected to a hollow manifold 20 which rests outside of the fireplace upon a floor 21 of a room 22. The manifold is connected to a duct 23 leading outwardly of the house through a wall 24 so that fresh air from outside of the house can be brought into the heater 10. The duct 23 is intercepted by a fan and motor unit 25 which may be located either outside the house, in the wall, or as shown, within the room. The unit 25 can be manually controlled by a knob 26 so to turn on or off, or supply a variable amount of air into the heater under force, as desired.

The opposite ends 27 of the pipes protrude through a metal supporting plate 28 positioned adjacent a from side of the wall 24 and located along a lower edge 29 of the fireplace opening 30. The ends 27 of each endmost pipe as sidewardly engled so to fan out the hot air across a broader range.

In operative use, it is now evident that a fire in the cradle will heat up the pipes so that air circulating therethrough is heated so to heat a room more efficiently. The air being fresh from out-of-doors has a sufficient oxygen supply for persons in the room and to feed the fire so that the fire is more intense. Up to 50 percent increase in heat is thus obtained from a fire.

Refering now to FIG. 3, a modified design 31 of the structure shown in FIG. 2, eliminates the use of the plate 28 so that more heat (indicated by arrows 32) can be reflected from the fireplace directly into the room because there is no plate to block the same.

Refering now to FIG. 4, another modified design 33 of a heater is the same as heater 10 except that it additionally includes an air outlet 34 along an upper side of pipe leg 14 so that a blast of oxygen laden fresh air can be brought directly against the underside of a fire so that it thus burns more intensely with a greater heat. This would be particularly also useful when starting a fire which otherwise is only smoldering because the wood is not being ignited such as occurs when insufficient paper or kindling wood is used to get the fire going.

The amount of the air blast can be controlled or shut off completely by a valve consisting of a sleeve 35 slidable around the pipe so to selectively block the outlet 34 as wished. The sleeve is affixed to a bar 36 that extends forwardly between legs 37 under the manifold, and the bar end 38 protruding forwardly into the room can be manually pushed or pulled to control the valve 39 that formed. In a still further modified design, the pipe leg 14 can have a circle of outlets 14 all around the same which can be selectively aligned or disaligned with an outlet opening on a side of the sleeve so that the air blast can be shut or directed into any direction toward a particular flame; this design having the sleeve connected to a control rod that is rotatable, instead of being pulled and pushed.

Thus modified designs of the invention are provided.

While various changes may be made in the detail construction, it is understood that such changes will be within the spirit and scope of the present invention, as is defined by the appended claims.

We claim:

1. An energy saving fireplace heater comprising in combination, a cradle placable into a fireplace and consisting of a series of generally C-shaped pipes in parallel spaced apart relation, each said pipe comprising a horizontal lower leg, a vertical leg and an upper horizontal leg with bends therebetween, an end of said lower leg being inserted into an air manifold connected to an air duct leading outwardly of a house, said duct being intercepted by a motor-driven fan having controls for variable speed, each said lower leg of each said pipe being supported above the fireplace floor by a leg near a rear end thereof, and the ends of said pipe upper legs extending into a room at various angular positions, said manifold being located outside the fireplace on the room floors wherein said ends of said pipe upper legs are all retained in a common supporting plate, wherein a valve is provided along each said pipe horizontal lower leg including an outlet directing air toward a fire upon said cradle, said valve comprising a sleeve slidingly mounted over a perforated portion of said lower leg and including a handle extending beyond the manifold into the room for controlling the amount of air directed upon the fire.

2. The device of claim 1 wherein the sleeve and perforations are arranged for selective adjustment to control both the quantity and direction of movement of the air providing better control of the fire.

* * * * *